US005988429A

United States Patent [19]

Coe

[11] Patent Number: 5,988,429

[45] Date of Patent: Nov. 23, 1999

[54] BLISTER PACK PILL DISPENSER

[75] Inventor: Matthew Coe, Asbury, N.J.

[73] Assignee: PharmaDesign, Inc., Warren, N.J.

[21] Appl. No.: 08/950,046

[22] Filed: Oct. 14, 1997

[51] Int. Cl.[6] ..... G07F 11/66

[52] U.S. Cl. ..... 221/25; 221/26; 206/531

[58] Field of Search ..... 221/26, 25; 206/531, 206/532, 539, 528

[56] References Cited

U.S. PATENT DOCUMENTS

| | | | |
|---|---|---|---|
| 3,324,996 | 6/1967 | Jordt | 206/531 |
| 4,074,806 | 2/1978 | Ardito | 206/531 |
| 5,019,125 | 5/1991 | Rebne et al. | 206/531 |

*Primary Examiner*—Kenneth W. Noland
*Attorney, Agent, or Firm*—Notaro & Michalos P.C.

[57] ABSTRACT

A dispenser for a blister pack which contains pills in a matrix of blisters has a support member for receiving the pack with a rupture side of the pack facing the support member. The support member has at least one opening for passage of pills pushed through the rupture side from the blister pack. A tab lid is hinged to the support member in a position covering the blister pack, the tab member having a matrix of tabs, each movably mounted to the tab lid and each positioned to be over a blister of the blister pack. Movement of a tab of the tab lid toward the support member effects compression of a blister to rupture the rupture side and push a pill out of the blister and through the opening of the support member. A cover lid can also be hinged to an opposite edge of the support member to cover the tab lid.

20 Claims, 6 Drawing Sheets

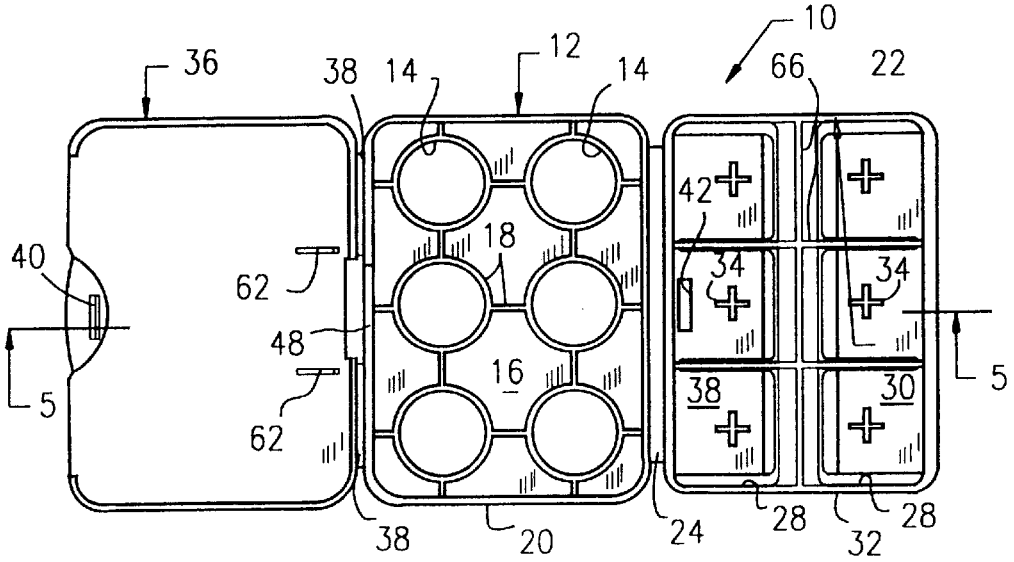
FIG. 1
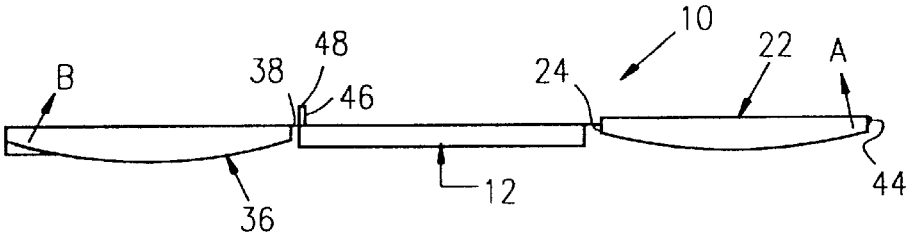
FIG. 2
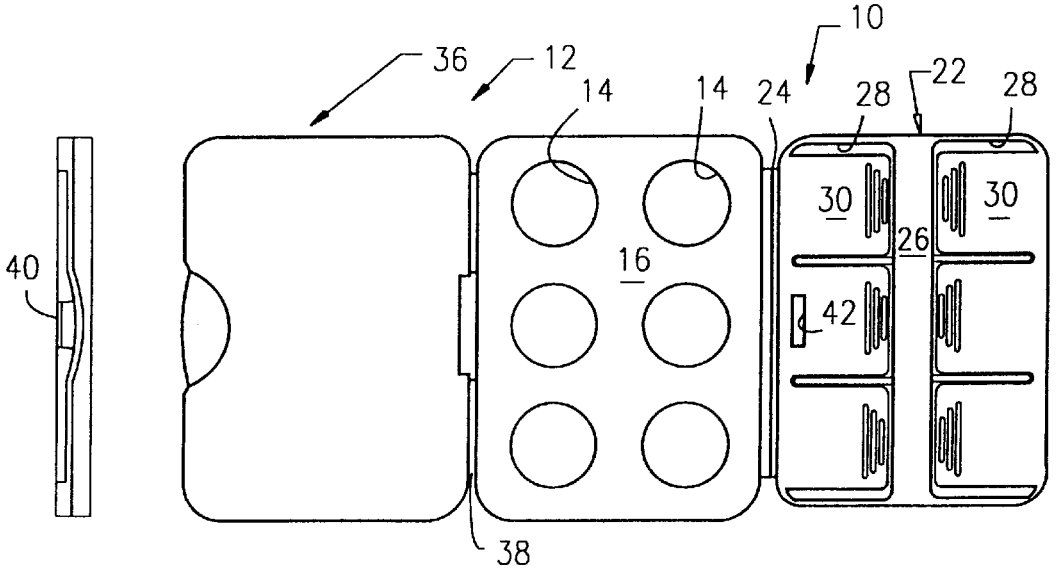
FIG. 4
FIG. 3

BLISTER PACK PILL DISPENSER

FIELD AND BACKGROUND OF THE INVENTION

The present invention relates, in general, to pill dispensers, and in particular, to a new and useful dispenser which is specially constructed to dispense pills that have been blister packed.

The use of blister packs to contain pills has become increasingly popular. Blister packs tend to be much more sanitary than loose pills in a bottle and are much less susceptible to tampering. By avoidance of light and moisture, greater product stability is achieved. Blister packs are commonly made of a transparent plastic sheet which has been formed to carry a matrix of depressions or blisters. One pill is received in each depression or blister. A foil or plastic backing is then firmly adhered across the plane of the sheet, sealing the pills in their respective blisters.

To extract a pill, a person must either cut the foil and plastic and then pull the cut edges apart to open one of the blisters, or push the pill through the foil backing to rupture the backing and extract the pill.

Throughout this disclosure, the term "pill" is used to identify not only pressed pills that are usually cylindrical in shape, but also elongated caplets, capsules, tablets, gelcaps and any other form of medication or vitamin amenably to being stored in blister packs.

A problem with known blister packs is that sometimes the pills are difficult to extract from the depression or blister, especially for the elderly and for individuals suffering from symptoms which are meant to be treated by the pill, for example in the case of an individual suffering from a migraine headache who is trying to extract headache medication from its blister pack.

A large number of unit dosage devices are also known, which are generally made of plastic and have multiple compartments, most commonly one compartment for each day of the week or multiple compartments for each day, for those individuals who must take medication more than once a day.

U.S. Pat. No. 5,489,025 to Romick, discloses a unit-dose dispenser which has provision for labelling daily dosages but which is also specially designed to receive blister packed dosages. The Romick patent captures a blister pack between top and bottom plates. Apertures are provided in the top plate for receiving the blisters and in the bottom plate for permitting discharge of a pill which is pressed from a blister. This reference does not make the extraction process any easier since the individual must still directly press the blister firmly to burst the foil below and extract the pill.

SUMMARY OF THE INVENTION

An object of the present invention is to provide a dispenser which contains and stores a blister pack and which also facilitates extraction of pills from the blister pack.

Accordingly, an object of the present invention is to provide a dispenser for a blister pack containing a plurality of pills in a plurality of blisters arranged in a matrix on the pack, the pack having a sheet member forming the matrix, the sheet member having a rupture member opposite the blisters, the dispenser comprising: a support member for receiving the blister pack with the rupture member facing the support member, the support member having at least one opening for passage of pills pushed through the rupture member from the blister pack; and a tab lid engageable to the support member in a position covering the blister pack, the tab lid having a matrix of tabs, each movably mounted to the tab lid and each positioned to be over a blister of the blister pack received by the support member, movement of a tab of the tab lid toward the support member effecting compression of a blister to rupture the rupture member and push a pill out of the blister and through the opening of the support member.

A further object of the present invention is to connect the tab lid to one side of the support member by a hinge, and to provide a cover lid hinged to the opposite side of the support member for covering the tab lid.

In the preferred embodiment of the invention, the support member contains one or more holes equal to and arranged to be under the blisters in the matrix so that each pill can be pushed through the rupture member or side of the sheet member and through its own hole in the support member. Although the holes in the support members may be shaped to correspond to the shapes of the blisters, this is not essential.

The tabs are also advantageously hinged to the lid at one side of each tab, the lid member, cover member and support member along with the tabs, all being made of a single piece of plastic material, in particular, injection molded polypropylene co-polymer which is strong enough to structurally form the dispenser yet flexible and resilient enough to allow the formation of "live hinges" made of thin plastic webs between the tab lid, the cover lid and the support member. The tabs can also be hinged to the tab lid using live hinges.

A further object of the present invention is to provide a dispenser for blister packs which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 1 is a top plan view of a first embodiment of the invention;

FIG. 2 is a side elevational view thereof;

FIG. 3 is a bottom plan view thereof;

FIG. 4 is an end view of the cover lid illustrating a latch projection used for closing the dispenser;

DESCRIPTION OF THE PREFERRED EMBODIMENT

Figure 6:
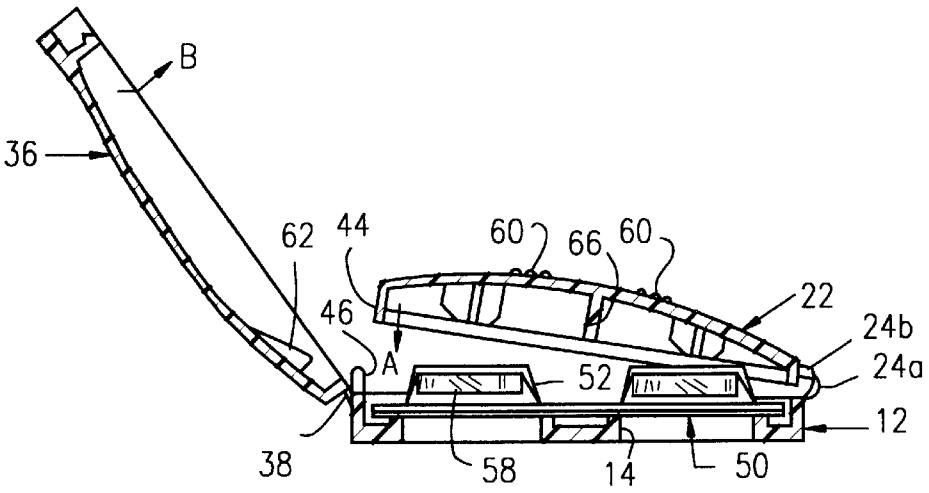
FIG. 6 is a view similar to FIG. 5 showing the dispenser partially closed.

Referring to the drawings in particular, the invention embodied in FIGS. 1 through 4 comprises a dispenser generally designated 10 for a blister pack containing pills which can be extracted from the pack by pushing the pills through a rupture side of the pack.

Dispenser 10 comprises a central support member or panel 12 having a plurality of openings 14 distributed in a matrix which corresponds to the matrix of blisters in the blister pack to be contained in the dispenser.

Support member 12 comprises a flat plate 16 having an upper surface with a pattern of raised ribs 18 for re-enforcing the plate 16. Advantageously, one of the rib members extends around each of the openings and additional rib members connect the ribs around the openings to a higher rib 20 formed around the rim of plate 16.

A tab lid 22 is hinged by a live hinge 24, that is, a thin web of plastic extending between side edges of lid 22 and support member 12. Tab lid 22 comprises a plate 26 containing a plurality of U-shaped slots 28 which each extend around three sides of a tab 30. Tabs 30 are arranged in the same matrix as openings 14. The end of each tab 30 which is connected to the plate 26 is adjacent a rim 32 around the perimeter of plate 26 which serves to stiffen the plate and also acts as a base for a hinge formed by the material of plate 26, to allow each tab 30 to pivot with respect to the plate 26. Each tab 30 includes a star shaped projection 34 which, as will be described later in greater detail, engages the top of a blister in the blister pack and, when the tab is pushed downwardly, collapses the blister to force a pill through the rupture side of the blister pack and out through the opening 14.

Although in the preferred embodiment of the invention an equal number of openings 14 is provided for, the number of blisters in the matrix in the pack, fewer and larger openings can be provided in support 12 to allow the passage of pills from multiple blisters. Since this may reduce the strength of the support member 12, it is preferred to provide a separate opening for each blister.

A cover lid 36 is connected by a pair of live hinges 38, to an opposite side of support member 12. With tablet 22 pivoted about hinge 24 in the direction of arrow A to cover support member 12, cover lid 36 can be pivoted in the direction of arrow B about its hinges 38, to enclose and cover lid 22.

Figure 5:
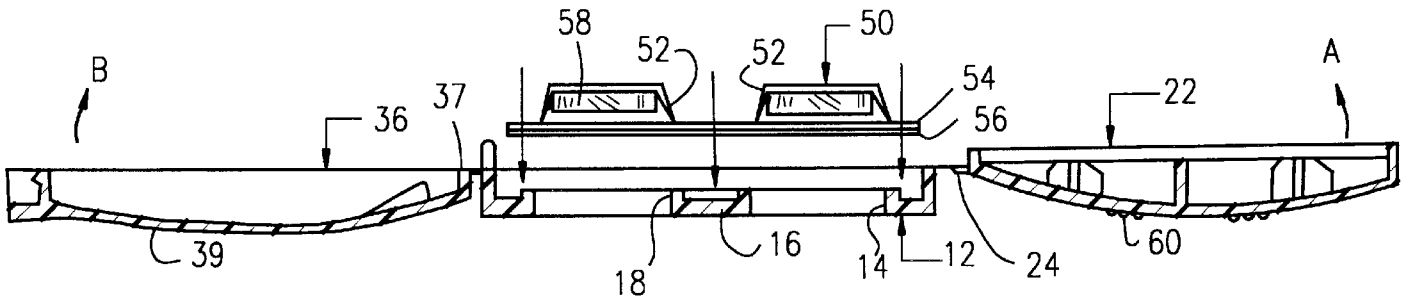
FIG. 5 is a sectional view taken along line 5—5 of FIG. 1 and illustrating a fully opened position of the invention for receiving a blister pack.
Figure 7:
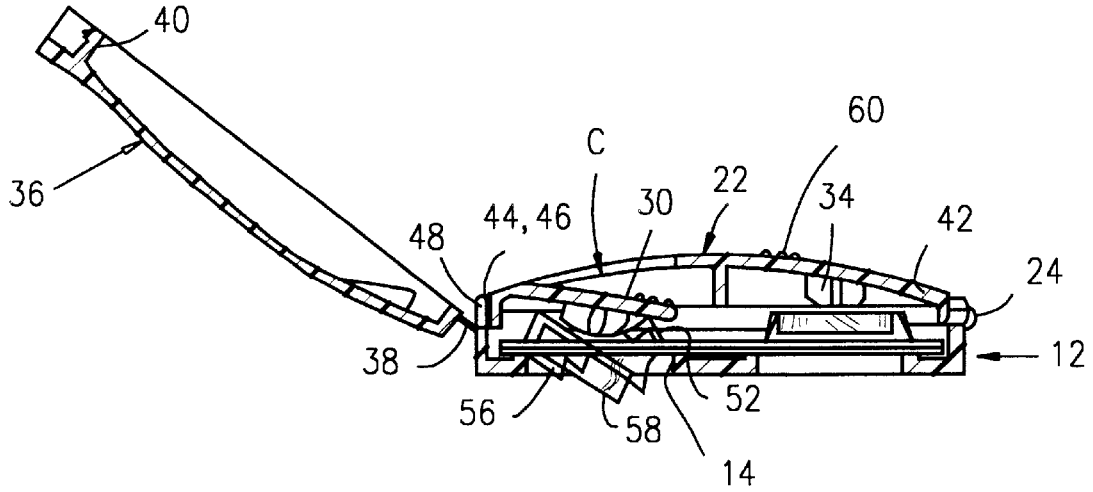
FIG. 7 is a view similar to FIG. 6 showing how movement of a tab causes dispensing of a pill from the blister pack.

In this position, a latch projection shown at 40 in FIG. 4 engages a latch aperture 42 in lid 22 to hold the cover lid and the tab lid closed. Tab lid 22 is also held in position on the support member 12 by engagement of a latch nib 44 under a latch nib 46 on a pedestal 48 extending upwardly from support member 12. As best shown in FIGS. 5, 6 and 7, lids 22 and 36 are pivoted in the direction of arrows A and B, after a blister pack 50 has been seated on the ribs 18 which line a common plane above plate 16 of support member 12. Blister pack 50 includes a matrix of blisters 52 which each contain a pill. Blister pack 50 comprises a plastic sheet member 54 which has a lower rupturable foil layer or member 56 forming a rupture side of the blister pack. Blisters 52 are shaped from the sheet member 54 to accommodate pills 58 which may be cylindrical, oblong or any other shape conventional for pills, tablets, caplets, capsules or other unit dose medication.

Figure 14:
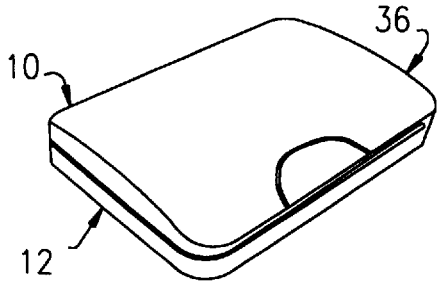
FIG. 14 is a perspective view showing the dispenser completely closed.

FIG. 7 illustrates the engagement of nibs 44 and 46 to keep tab lid 22 closed over the pack 50. FIG. 7 also illustrates how latch aperture 42 is positioned at the far side of tab lid 22, for receiving latch protection 40 which has a hooked end for firmly engaging into latch aperture 42 to close the dispenser. The closed position of the dispenser is shown in FIG. 14. As shown in FIG. 7, pressure can be exerted on one of the tabs 30 in the direction of arrow C to pivot the tab downwardly with respect to the remainder of tab lid 22. The star shaped projection 34 then collapses blister 52, forcing pill 58 to rupture foil 56, causing the pill to drop through the opening 14 and into the hand of the user. A finger is advantageously used to exert pressure C. Ridges 60 are provided near the outer free end of each tab 30 to induce the user to press the tab at this point, adding leverage to the action of projection 34 on the collapsing blister. It is much easier to press the broad surface of tab 30 with reduced sliding due to ridges 60, then to press the blister itself to extract a pill. The dispenser of the present invention also protects the blister against premature rupturing and against dirt and inadvertent access. The fact that the cover lid 36 must first be removed from over tab lid 22 enhances the purposeful nature of extracting a pill from the blister pack.

Figure 13:
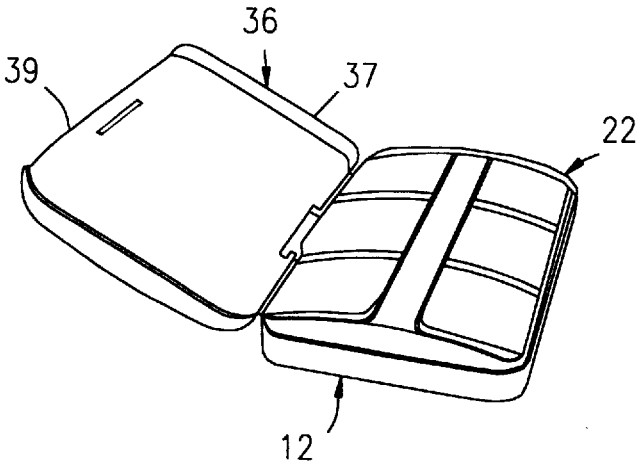
FIG. 13 is a perspective view showing the dispenser partially closed.

As best shown in FIG. 5, live hinge 24 has two sections, a thick walled section connected directly to lid 22 and a thin walled section connected directly to support member 12. This is to properly position lid 22 on support 12 as shown in FIGS. 6 and 13, since the thin walled section **24*a* will bend while the thick walled section 24*b* will not bend, accurately establishing the lateral position of lid 22 on support member 12, and insuring proper engagement of latch nib 44 under latch nib 46 on the side of the structure opposite from hinge 24**.

FIG. 6 also illustrates one of a pair of ramps 62 which project downwardly from the inner surface of cover lid 36. Ramps 62 firmly engage the top surface of tab lid 22, when the dispenser is closed, to prevent rattling and movement of the blister pack within the dispenser. The fact that hinges 38 are interrupted in the vicinity of pedestal 48, also permits lid 36 to pivot onto lid 22, without interfering with the pedestal 48.

In the embodiment of FIG. 1, cross shaped projections 34 are used and have sloping, curved surfaces as best shown in FIG. 6. This helps distribute the force exerted by the tabs 30 on the blisters for smoothly collapsing the blisters to extract a pill.

Figure 8:
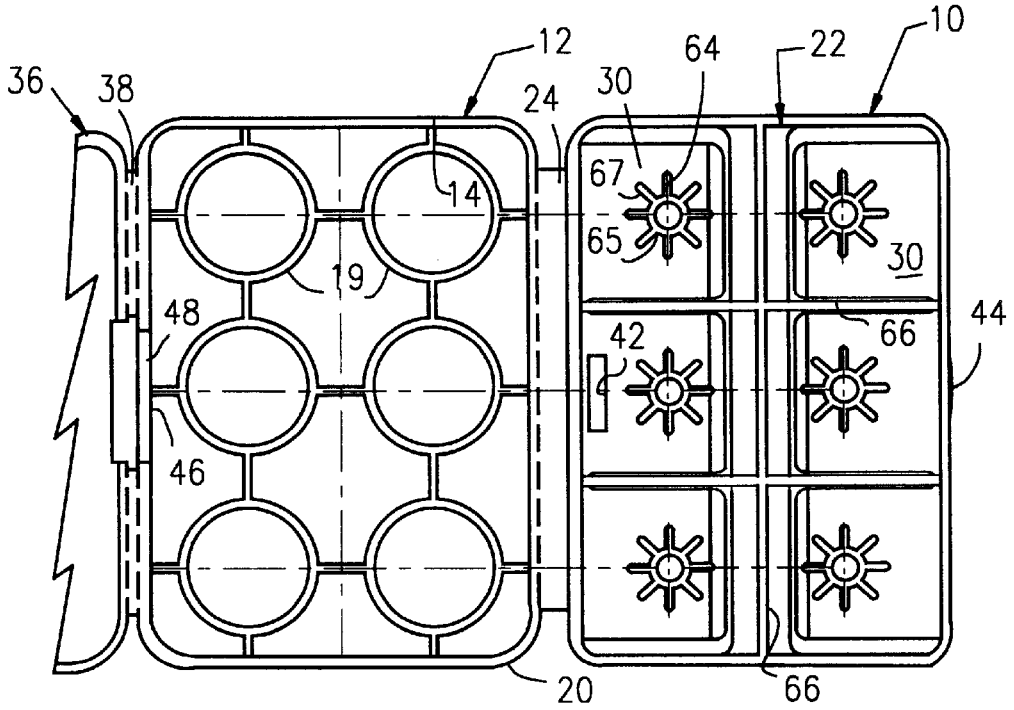
FIG. 8 is a partial top plan view of a second embodiment of the invention.

A more elaborate star shaped projection 64 is used on the tabs 30 in the embodiment of FIG. 8. Throughout the figures, the same reference numerals are utilized to designate the same or functionally similar parts.

Figure 9:
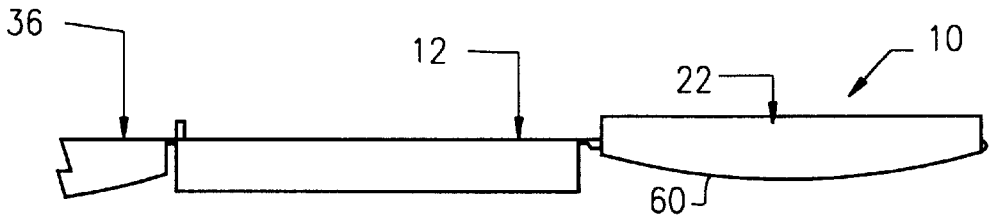
FIG. 9 is a partial side elevational view of the embodiment of FIG. 8.
Figure 10:
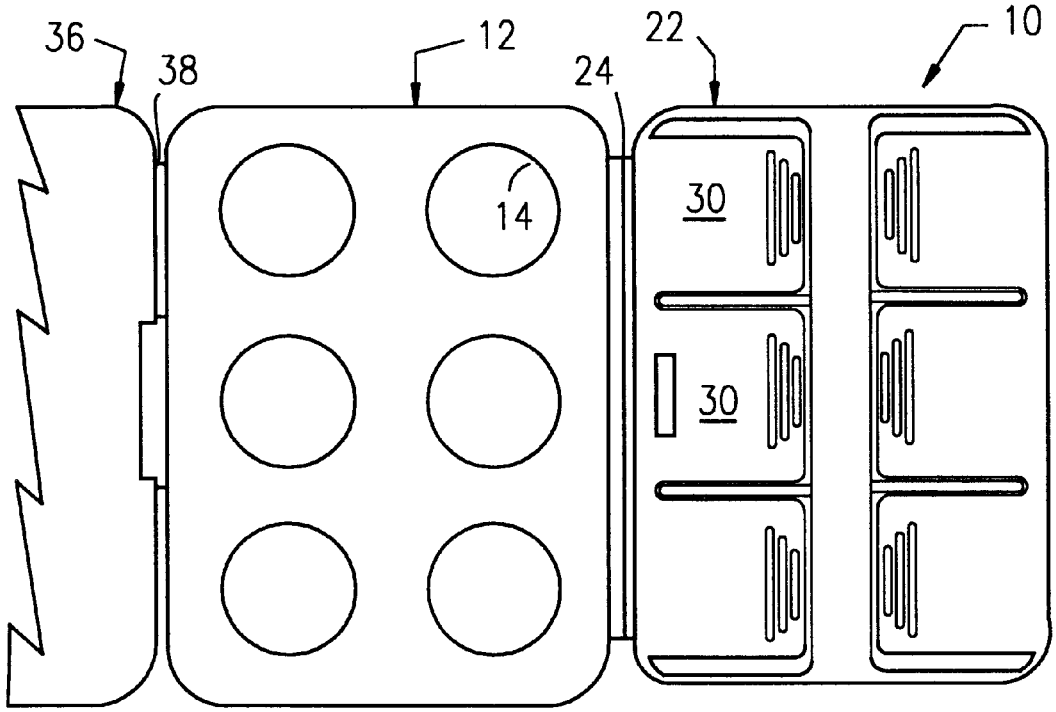
FIG. 10 is a bottom plan view of the embodiment of FIG. 8.

In the embodiment of FIGS. 8, 9 and 10, elements with the same reference numerals have the same structure and purpose as in the embodiments of FIGS. 1–7 so that their description will not be repeated.

FIG. 8 illustrates another feature which is shared by the embodiment of FIG. 1, that is, the presence of a grid of reinforcing ribs 66 on the inner surface of tab lid 22. Ribs 66 cross between the two rows of tabs 30 and between each column of tabs to reinforce the lid 22 and support the pivotal movement of each of the tabs. The star shaped projections 64 each comprise an inner cylindrical projection 65 and a plurality of radial spokes 67.

Figure 11:
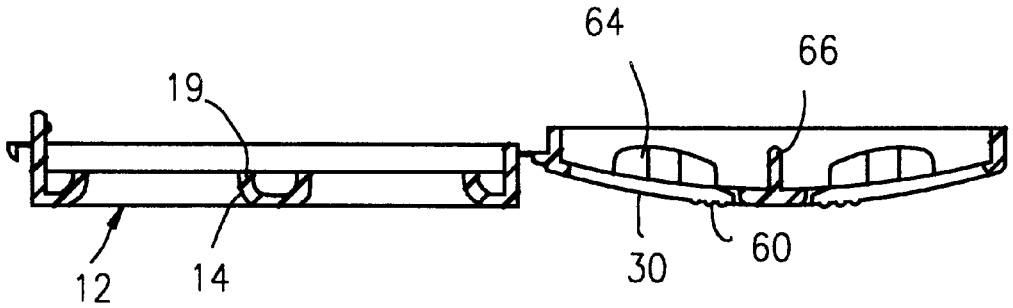
FIG. 11 is a partial sectional view of the embodiment of FIG. 8.

FIG. 11 illustrates the curved contour of the cylinder-plus-spoke projection 64 on each of the tabs 30 to facilitate smooth collapsing of a blister in the blister pack.

FIG. 11 also illustrates how curved ribs 19 can be used in support member 12 to create the openings 14.

It is important that the surface defined by the upper edges of ribs 19 in FIG. 11 and 18 in FIG. 1, be spaced by a sufficient distance from the plane defined by the highest points of the projections 34 or 64 in order to accommodate the blisters without prematurely rupturing the blisters when the tab lid 22 is closed.

It is also useful to dimension the support member 12, and in particular, the extent of its rim 20, to be only slightly larger than the outer periphery of the blister pack sheet 54 to insure proper alignment of the blisters 52 with the openings 14. Some movement may be accommodated, however, as long as the openings 14 are large enough to pass the pills when they are pushed through the rupture side of the blister pack.

Figure 12:
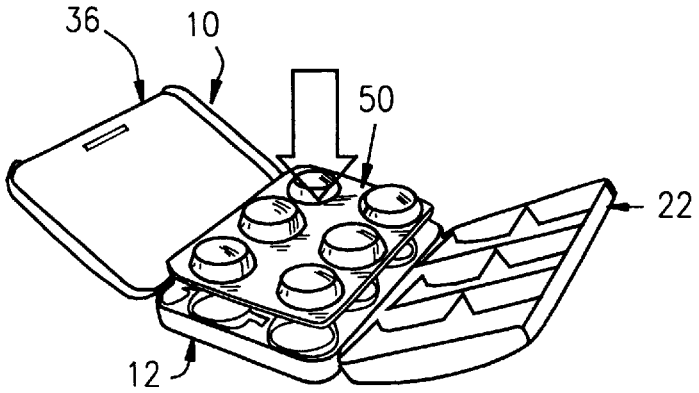
FIG. 12 is a perspective view showing the open dispenser of the invention for receiving a blister pack.

FIG. 12 is a perspective illustration of the dispenser as it is receiving a blister pack 50 with lids 22 and 36 open.

FIG. 13 illustrates the dispenser with lid 22 closed on support 12 while FIG. 14 shows the closed dispenser with lid 36 enclosing lid 22 in only the outer surfaces of support 12 and lid 36 visible. For this purpose, lid 36 is a clam-shell structure having side walls 37 and a curved outer wall 39.

Although a cover lid 36 is illustrated in the preferred embodiments of the invention, the cover lid may be eliminated for some purposes, relying only on the support member 12 being closed by tab member 22.

While a specific embodiment of the invention has been shown and described in detail to illustrate the application of the principles of the invention, it will be understood that the invention may be embodied otherwise without departing from such principles.

What is claimed is:

1. A dispenser for a blister pack containing a plurality of pills in a plurality of blisters arranged in a matrix on the pack, the pack having a sheet member forming matrix, the sheet member having a rupture member opposite the blisters, the dispenser comprising;

a support member for receiving the blister pack with the rupture member, facing the support member, the support member having at least one opening for passage of pills pushed through the rupture member from the blister pack;

a tab lid engageable to the support member in a position covering the blister pack, the tab lid having a matrix of tabs, each movably mounted to the tab lid and each positioned to be over a blister of the blister pack which is received by the support member, movement of a tab of the tab lid toward the support member effecting compression of a blister to rupture the rupture member and push a pill out of the blister and through the opening of the support member; and a cover lid engageable to the support member over the tab lid for covering the tabs.

2. A dispenser according to claim 1 including an equal number of openings in the support member as the number of blisters in the matrix, positioned to correspond to the matrix.

3. A dispenser according to claim 1 wherein each tab is hinged to the tab lid near an outer perimeter of the tab lid.

4. A dispenser according to claim 1 wherein the tab lid is made as one piece of plastic material with the support member and is connected to the support member by a live hinge between adjacent edges of the tab lid and support member.

5. A dispenser according to claim 1 wherein the cover lid is connected by a live hinge to an edge of the support member opposite from an edge connected to the tab lid, for engaging over the tab lid to cover the tab lid.

6. A dispenser according to claim 1 including a projection extending from each tab toward the support member when the tab lid is engaged to cover the blister pack.

7. A dispenser according to claim 6 wherein the projection is star shaped.

8. A dispenser according to claim 7 wherein the projection includes a cylindrical portion and a plurality of radial spokes extending outwardly from the cylindrical portion.

9. A dispenser according to claim 1 wherein the tab lid is hinged to the support member at edges of the tab lid and support member which are adjacent each other, a pedestal extending upwardly from the support member at an edge of the support member opposite to the edge adjacent the tab lid, a latch nib extending from the pedestal, the tab lid having a latch nib on an outer edge of the tab lid spaced from the support member adjacent edge, for engaging the nib on the pedestal for holding the tab lid closed on the support member.

10. A dispenser according to claim 1 wherein the tab lid is hinged to the support member at one edge of the support member, the cover lid hinged to the support member on an opposite edge of the support member, and latch means on the tab lid and cover lid for holding the cover lid closed on the tab lid.

11. A dispenser according to claim 10 wherein the latch means comprises a latch aperture in the tab lid and a latch projection extending from the cover lid and engageable into the latch aperture.

12. A dispenser according to claim 1 wherein each tab of the tab lid includes at least one ridge on the surface of the tab opposite from the support member.

13. A dispenser according to claim 1 including reinforcing ribs on the tab lid and on the support member for strengthening the tab lid and support member.

14. A dispenser according to claim 13 wherein the support member includes at least one rib around each opening.

15. An arrangement according to claim 1 wherein the tab member is hinged to one edge of the support member, the cover lid hinged to an opposite edge of the support member for covering the tab lid, and at least one ramp on an inner surface of the cover lid for engaging an outer surface of the tab lid to hold the tab lid against a blister pack supported on the support member.

16. A dispenser for a blister pack containing a plurality of pills in a plurality of blisters arranged in a matrix on the pack, the pack having a sheet member forming matrix, the sheet member having a rupture member opposite the blisters, the dispenser comprising;

a support member for receiving the blister pack with the rupture member facing the support member, the support member having at least one opening for passage of pills pushed through the rupture member from the blister pack;

a tab lid engageable to the support member in a position covering the blister pack, the tab lid having a matrix of tabs, each movably mounted to the tab lid and each positioned to be over a blister of the blister pack which is received by the support member, movement of a tab of the tab lid toward the support member effecting compression of a blister to rupture the rupture member and push a pill out of the blister and through the opening of the support member; and a projection extending from each tab toward the support member when the tab lid is engaged to cover the blister pack, the projection being star-shaped.

17. A dispenser for a blister pack according to claim 16, including a star-shaped projection extending from each tab toward the support member when the tab lid is engaged to cover the blister pack, the projection including a cylindrical portion and a plurality of radial spokes extending outwardly from the cylindrical portion.

18. A dispenser for a blister pack containing a plurality of pills in a plurality of blisters arranged in a matrix on the pack, the pack having a sheet member forming matrix, the sheet member having a rupture member opposite the blisters, the dispenser comprising;

a support member for receiving the blister pack with the rupture member facing the support member, the support member having at least one opening for passage of pills pushed through the rupture member from the blister pack;

a tab lid engageable to the support member in a position covering the blister pack, the tab lid having a matrix of tabs, each movably mounted to the tab lid and each positioned to be over a blister of the blister pack which is received by the support member, movement of a tab of the tab lid toward the support member effecting compression of a blister to rupture the rupture member and push a pill out of the blister and through the opening of the support member, the tab lid being hinged to the support member at edges of the tab lid and support member which are adjacent each other, a pedestal extending upwardly from the support member at an edge of the support member opposite to the edge adjacent the tab lid, a latch nib extending from the pedestal, the tab lid having a latch nib on an outer edge of the tab lid spaced from the support member adjacent edge, for engaging the nib on the pedestal for holding the tab lid closed on the support member.

19. A dispenser for a blister pack containing a plurality of pills in a plurality of blisters arranged in a matrix on the pack, the pack having a sheet member forming matrix, the sheet member having a rupture member opposite the blisters, the dispenser comprising;

a support member for receiving the blister pack with the rupture member facing the support member, the support member having at least one opening for passage of pills pushed through the rupture member from the blister pack; and a tab lid engageable to the support member in a position covering the blister pack, the tab lid having a matrix of tabs, each movably mounted to the tab lid and each positioned to be over a blister of the blister pack which is received by the support member, movement of a tab of the tab lid toward the support member effecting compression of a blister to rupture the rupture member and push a pill out of the blister and through the opening of the support member; and reinforcing ribs on the tab lid and on the support member for strengthening the tab lid and support member.

20. A dispenser for a blister pack according to claim 19, wherein the support member includes at least on rib around each opening.

* * * * *